US012594648B2

(12) United States Patent
Pavlovic et al.

(10) Patent No.: US 12,594,648 B2
(45) Date of Patent: Apr. 7, 2026

(54) DRESSING TOOL AND METHOD FOR THE PRODUCTION THEREOF

(71) Applicant: Reishauer AG, Wallisellen (CH)

(72) Inventors: Marin Pavlovic, Bruttisellen (CH); Sergio Manuel Monteiro Ferreira, Egg (CH); Christoph Rudolf, Wallisellen (CH)

(73) Assignee: Reishauer AG, Wallisellen (CH)

( * ) Notice: Subject to any disclaimer, the term of this patent is extended or adjusted under 35 U.S.C. 154(b) by 787 days.

(21) Appl. No.: 17/753,443

(22) PCT Filed: Apr. 8, 2020

(86) PCT No.: PCT/EP2020/060072
§ 371 (c)(1),
(2) Date: Mar. 3, 2022

(87) PCT Pub. No.: WO2021/058142
PCT Pub. Date: Apr. 1, 2021

(65) Prior Publication Data

US 2022/0314398 A1 Oct. 6, 2022

(30) Foreign Application Priority Data

Sep. 24, 2019 (CH) ..... 01217/19

(51) Int. Cl.
*B24B 53/12* (2006.01)
*B24B 53/075* (2006.01)
*B24D 18/00* (2006.01)

(52) U.S. Cl.
CPC ..... *B24B 53/12* (2013.01); *B24B 53/075* (2013.01); *B24D 18/00* (2013.01)

(58) Field of Classification Search
CPC ..... B24B 53/12; B24B 53/075; B24B 53/053; B24B 53/07; B24B 53/04; B24B 53/047;
(Continued)

(56) References Cited

U.S. PATENT DOCUMENTS 2,988,860 A 6/1961 Sohl
3,491,740 A 1/1970 Kohlstrunk
(Continued)

FOREIGN PATENT DOCUMENTS

DE 7003805 U 5/1970
DE 19910747 A1 * 9/2000 ..... B23F 23/1225
(Continued)

OTHER PUBLICATIONS

English translation of Request for the Submission of an Opinion issued by the South Korean Patent Office on Jan. 10, 2025 for South Korean Patent Application No. 10-2022-7006855.
(Continued)

*Primary Examiner* — Michael A Gump
(74) *Attorney, Agent, or Firm* — Brian Roffe

(57) ABSTRACT

Dressing tool which has profiled elements arranged coaxially with one another and which are each provided with a profile form, which is tapered or the like in its axial cross-section and has working surfaces provided with hard-material particles. The profiled elements are delimited at their outer circumference by at least one generated surface. The dressing tool preferably includes six profiled elements arranged coaxially with one another, and a one-part or two-part metallic main body for the entire dressing tool or for a particular generated surface. The profile forms with the hard-material particles of the profiled elements may be produced by a negative process with a casting compound applied to the particular main body. This dressing tool can thus be used for a profiling of grinding worms extremely productively and precisely and also such that they can be corrected.

12 Claims, 4 Drawing Sheets

(58) Field of Classification Search
CPC ..... B24B 53/14; B24B 53/082; B24B 53/093; B24B 53/085; B24B 18/00; B24B 18/0018; B24B 18/0009; B24B 3/346; B24B 19/009; B24B 27/0046; B24B 27/0084; B24B 47/22; B24D 18/00; B24D 18/0018; B24D 18/0009; B23F 19/052; B23F 19/055; B23F 21/03; B23F 21/026; B23F 23/1231; B23F 23/1225
USPC ..... 125/11.03; 451/443, 56, 47, 247
See application file for complete search history.

(56) References Cited

U.S. PATENT DOCUMENTS

| | | | | |
|---|---|---|---|---|
| 3,913,278 | A | 10/1975 | Kokoras et al. | |
| 4,681,600 | A | 7/1987 | Rhoades et al. | |
| 5,339,794 | A | 8/1994 | Thyssen | |
| 7,121,930 | B2 * | 10/2006 | Thyssen | B24B 53/075 451/5 |
| 8,597,085 | B2 * | 12/2013 | Rudolf | B24B 53/075 125/11.03 |
| 8,657,652 | B2 | 2/2014 | Hwang et al. | |
| 9,180,574 | B2 | 11/2015 | Wunder et al. | |
| 9,839,990 | B2 | 12/2017 | Hanni et al. | |
| 10,160,095 | B2 | 12/2018 | Rudolf et al. | |
| 10,507,564 | B2 | 12/2019 | Schmueck | |
| 2001/0004581 | A1 | 6/2001 | Gerl | |
| 2009/0227182 | A1 | 9/2009 | Breith et al. | |
| 2015/0011142 | A1 * | 1/2015 | Breith | B23F 21/005 451/65 |
| 2015/0133036 | A1 * | 5/2015 | Sung | B24B 53/017 451/443 |
| 2016/0176018 | A1 * | 6/2016 | Hanni et al. | B24B 53/04 451/443 |
| 2017/0225249 | A1 * | 8/2017 | Schieke | B24B 53/075 |

FOREIGN PATENT DOCUMENTS

| | | | |
|---|---|---|---|
| JP | S61-173861 | A | 8/1986 |
| JP | H8-174429 | A | 7/1996 |
| JP | 2001-179624 | A | 7/2001 |
| JP | 2005-313320 | A | 11/2005 |
| JP | 2010-536183 | A | 11/2010 |
| JP | 2011-126006 | A | 6/2011 |
| KR | 10-2010-0051856 | A | 5/2010 |
| KR | 10-2011-0069711 | A | 6/2011 |
| WO | 2018092361 | A1 | 5/2018 |
| WO | 2021058142 | A1 | 4/2021 |

OTHER PUBLICATIONS

English translation of Notice of the Reasons for Refusal issued by the Japanese Patent Office on Feb. 13, 2024 for Japanese Patent Application No. 2022-512390.

* cited by examiner

DRESSING TOOL AND METHOD FOR THE PRODUCTION THEREOF

FIELD OF THE INVENTION

The invention relates to a dressing tool with profiles arranged coaxially to one another, each with a profile form in conical or similar shape in axial cross-section and with working surfaces provided with hard-material particles, wherein the profiles are delimited at the outer circumference by at least one surface, and a method for its production.

BACKGROUND OF THE INVENTION

The dressing of grinding worms is itself a very demanding generating machining process in the field of roll grinding, which is based on a large number of synchronized and highly precise individual movements and is carried out by special dressing tools. For high productivity rates, full-profile rolls are used as typical rotating dressing tools for the lower module region, which are characterized by the fact that they combine all the profiling tasks for the worm flanks, heads, and feet in one tool. In this situation, the correct adjustment to the geometry of the work gear flank is essential, and leads to very limited flexibility in application. Accordingly, one negative aspect is the absence of the possibility of correction, for example in the event of profile angle deviations. With these tools, however, comparatively short dressing times can be achieved.

Disclosed in the printed publication DE-A-10 2009 059 201, which corresponds to U.S. Pat. No. 8,597,085, is a full-profile dressing roller for dressing or profiling multi-thread grinding worms for the roll grinding of small modular gear wheels. This is provided with a groove-shaped axial cutting profile with an outer casing surface covered with particles of hard material and with profile-cut hard material segments embedded into this casing surface. This dressing roller with the profile comb elements is produced in a negative mold by metal removal using a known negative machining technique, which has an inner surface shaped so as to be complementary to the outer casing surface of the dressing roller.

With a dressing tool according to the printed publication DE-A-43 39 041, which corresponds to U.S. Pat. No. 5,339,794, for profiling two-thread cylindrical grinding worms for the roll grinding of spur gear wheels, a first dressing roller is provided, with two opposed conical first and second flanks covered with hard material particles, and coaxial second and third dressing rollers. The three dressing rollers are clamped onto a common shaft or sleeve, and are also separated from one another by two spacing disks. With such a dressing tool, the three dressing rollers engage into three adjacent grinding worm threads, such that a slight enlargement of the dressing stroke occurs, but a substantial stroke shortening is also achieved. This dressing tool is relatively elaborate and expensive to produce, but despite that it is still unsuitable for high-precision profiling. This also means that it is also not possible to produce high-precision flank profiles on the grinding worm, which has a directly negative effect on the precision of the gear wheels which are to be produced.

The main problem with many of these different dressing techniques is the fact that, in spatial terms, there are always two spatial working surfaces moving on the worm flank and on the dressing tool, and in this context these surfaces are often also composed of part surfaces. Under these spatial moving contact conditions, contact points often occurred, determined by the geometry, which do not lie in the axial sectional plane of the dressing tool. When this occurs, even with the most careful arrangement of the dressing profile, it is very often the case that the resulting quality of dressing and grinding is inadequate.

With roll grinding it has been shown that, for the dressing of grinding worms, the known full-profile roller in particular can be used with versatile effect, but also set-profile rollers. In this situation, these dressing tools are in each case used separately for different function sectors, wherein the scattered or hand-set diamond covering of the full-profile roller is applied in the galvanically negative process, and the corresponding diamond covering of the set-profile roller is applied in the galvanically positive process. The precision to be maintained by the set-profile roller has hitherto required the use of the galvanically positive process, with the possibility of subsequent reworking.

In practice, in the series manufacture of gear wheels, the full-profile roller has hitherto proved to be very suitable for the profiling of grinding worms. Due to the contact of a full-profile roller over multiple grinding worm threads, however, a correction of a profile angle deviation is not possible.

For other tooth forming tasks, with corrections required of the profile angle deviation, use is also very often made for dressing of what are referred to as set-profile rollers. Both dressing tools require only one rotating dressing spindle, and, with the use of set-profile rollers, additionally an NC axle for pivoting this dressing spindle. Although this set-profile roller does not achieve the productivity of the full-profile roller, and also is only suitable for the profiling of one worm thread, it is possible in practice to achieve with this dressing tool an adequately great degree of pivot to allow for the rendering symmetrical of profile angle deviations, as well as pitch changes for the symmetrical influencing of these profile angle deviations. Accordingly, it is possible with this dressing tool for a process-incurred profile angle deviation of approximately one angle minute to be reliably corrected, which then comes into full effect if, during the profiling of a grinding worm with an initial diameter of, for example, approximately 300 mm, this is then reduced to approximately 100 mm due to a large number of dressing movements during the grinding of a batch.

OBJECTS AND SUMMARY OF THE INVENTION

The invention is based on the object of providing a dressing tool, based on these known full-profile rollers and set-profile rollers, by means of which grinding worms can be profiled extremely productively, precisely, and also with the possibility of correction. It is also intended that these can be rationally produced and incur a substantial increase in the service life of the dressing tool.

This object is solved according to the invention by a dressing tool that includes between two and preferably six profiles arranged coaxially to one another, and a one-part or two-part metallic main body for the entire dressing tool or for a respective casing surface, wherein the profile forms with the hard-material particles of the profiles are produced by a negative process with a casting compound applied on the respective main body. This object may also be solved according to the invention by a method for producing a dressing tool using negative process, with at least one negative mold and with complementary profile molds, by galvanic application of hard-material particles by means of centrifugal force. Special hard-material particles are fixed into the base of the positive mold complementary to the negative mold, which, after the removal of the negative mold, remain at the outer radii of the profile molds of the profiles, and protect the region of the dressing tool particularly subject to wear during the profiling of the grinding worm.

According to the invention, the dressing tool comprises between two to preferably six profiles arranged coaxially to one another, and a metallic main body, wherein all profile forms are produced with the hard material particles of the profiles by a negative process with a casting compound applied to the main body.

The dressing tool is produced with the known negative process. The high-precision nickel-diamond matrix produced in this way is then connected to the main body by means of a casting compound, or also in the form of adhesives and/or other castable materials, and produces the dressing tool according to the invention as one unit. The main body with the casting compounds and the nickel-diamond matrix can be configured as being of one part or two parts.

With this main body, and a light casting compound which is vibration-inhibiting and therefore has a damping effect, it is possible when in operation for interfering oscillations on the rotating spindle which receives the dressing tool to be substantially reduced or even eliminated.

Very advantageously, the profiles of the dressing tool, arranged coaxially to one another, form at least two differently shaped casing surfaces, to each of which a one-piece metallic main body is assigned, secured coaxially to one another. This dressing tool therefore consists of the main body, the galvanically-produced nickel-diamond matrix, and the casting compound which binds the nickel-diamond matrix to the main body.

With this compact structure of the dressing tool, with the different casing surfaces formed on the outside by the profiles, advantages of both dressing tools are achieved in different respects, and this dressing tool can even be produced with lower manufacturing costs.

These casing surfaces of the profiles are conical, cylindrical, and/or of other shapes, and the profiles of a respective casing surface are very advantageously configured as what are referred to as set-profile rollers and full-profile rollers. Accordingly, with this dressing tool, the highly productive and extremely precise profiling of grinding worms is possible.

With the method according to the invention, with the negative process involving at least one negative mold and complementary profile forms, by the galvanic application of hard-material particles by means of centrifugal force, special hard-material particles can be fixed into the base of the complementary profile form to the negative mold. After the removal of the negative mold, these will then predominantly remain on the outer radii of the profile forms of the corresponding profiles, and protect the region of the dressing tool which is particularly subject to wear during the profiling of the grinding worms, and therefore increases the overall service life of the dressing tool.

BRIEF DESCRIPTION OF THE DRAWINGS

The invention and its further advantages are explained in greater detail hereinafter on the basis of exemplary embodiments, and making reference to the drawings. The Figures show.

DETAILED DESCRIPTION OF THE INVENTION

Figure 1:
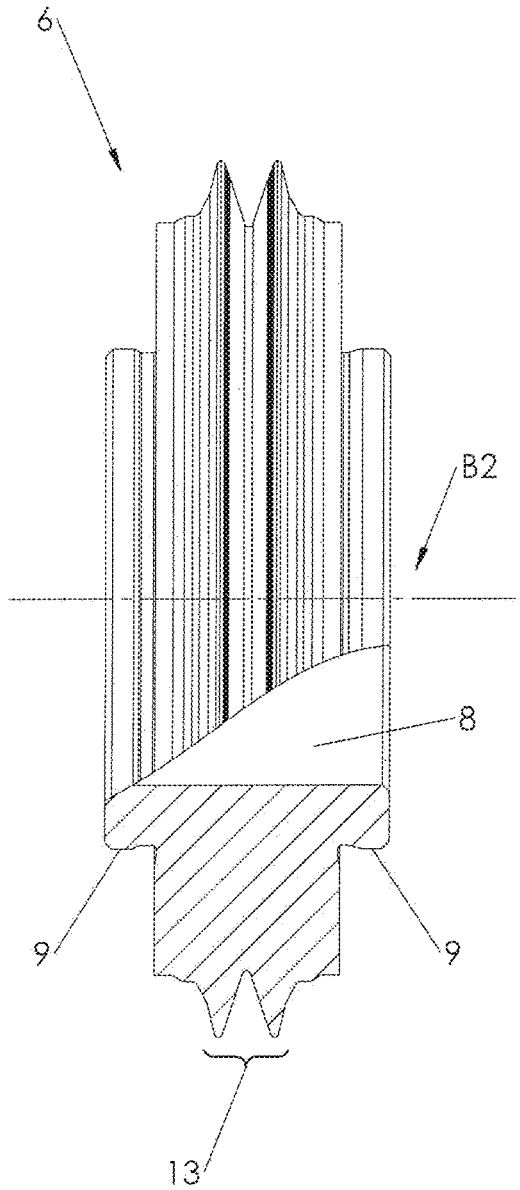
FIG. 1 PRIOR ART
FIG. 1 is a view with a partial longitudinal section of a dressing tool as the prior art.
Figure 2:
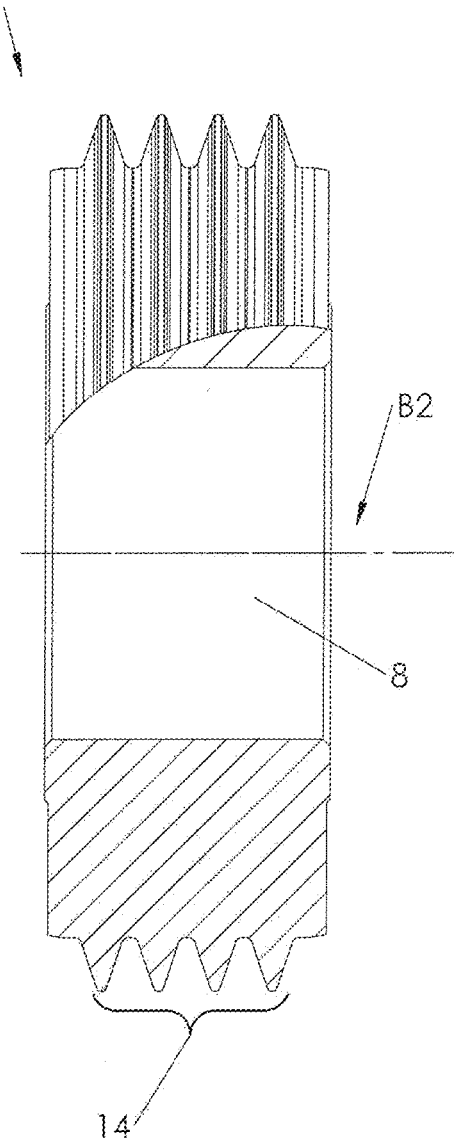
FIG. 2 PRIOR ART
FIG. 2 is a view with a partial longitudinal section of a further dressing tool as the prior art.

FIG. 1 and FIG. 2 each show a known dressing tool 6, 7, which serves to carry out the profiling of the flanks of grinding worms 1 which can be dressed, and which in turn are used for the grinding of correspondingly configured gear wheels. Advantageously, such dressing tools 6, 7 are suitable for gear wheels in the module range from 0.15 to 5 mm. Represented in each case are the rotation axles B2, the holes 8, and the testing collars 9 arranged on both sides in the form of a hub.

With the dressing tools 6 and 7, which are configured as what are referred to as set-profile rollers and full-profile rollers, the profiles 11.1, 11.2, and respectively 12.1, 12.2, 12.3, 12.4, are formed by profile grooves, of which the working surfaces 13 and 14 respectively are formed by opposing flanks with head regions and feet regions, and which are provided with corresponding hard-material particles 21, 22.

Figure 3:
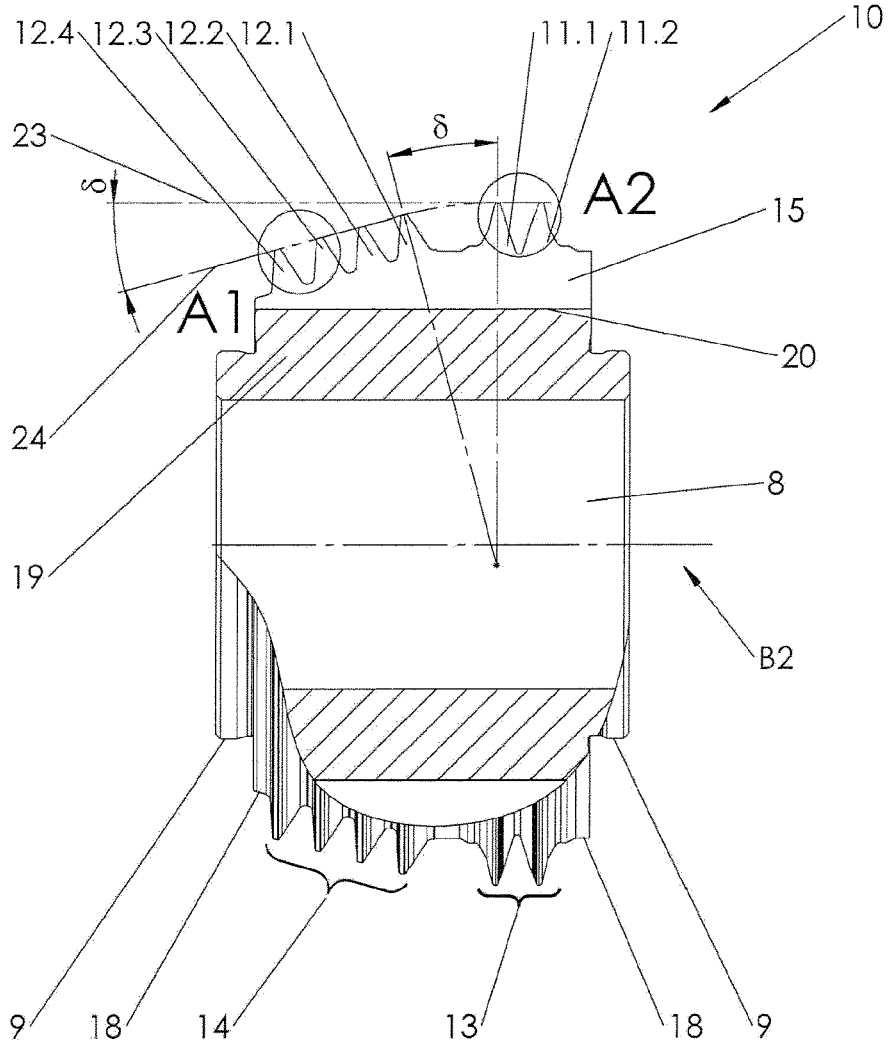
FIG. 3 is a longitudinal section with a partial view of a dressing tool according to the invention.

FIG. 3 shows a dressing tool 10, which is provided with profiles 11.1, 11.2, 12.1, 12.2, 12.3, 12.4, arranged in a coaxial orientation along the axis B2. In this situation, these profiles are delimited at their outer circumference by two casing surfaces 23, 24, of which one is shaped approximately cylindrically and the other is conical. In this situation, this conical casing surface 24, seen in the axial cross-sectional view, runs at an angle δ to the cylindrical surface 23. Arranged in a row on the conical surface 24 are up to four profiles 12.1, 12.2, 12.3, 12.4 (referred to as a set of profiles), each with a working surface 14 as a full-profile, and two profiles 11.1, 11.2 are arranged on the cylindrical surface 23 (referred to as another set of profiles), each with a working surface 13, as a set-profile.

It is of course possible for the number of the profiles to be configured differently as required, and therefore also the working surfaces 13 and 14 and/or the form of the surfaces 23, 24, of this dressing tool 10. Accordingly, within the framework of the invention, the dressing tool 10 can also have only three profiles 11.1, 11.2, 12.1, arranged coaxially to one another, wherein these three profiles are carried on the main body 19 by means of a casting compound 15.

According to the invention, this dressing tool 10, with the multiple profiles 11.1, 11.2, 12.1, 12.2, 12.3, 12.4, comprises a metallic main body 19 with the respective surfaces 23, 24, wherein the profile shapes of these profiles 11.1, 11.2, 12.1, 12.2, 12.3, 12.4 consist of a diamond-permeated nickel matrix, produced by means of a negative process, which is connected to the main body 19 by the casting compound 15. In this situation, after the diamond-permeated nickel matrix has been applied to the negative mold by means of centrifugal force, and after the precise placement of the main body 19, the filling or casting of the casting compound 15 into the cavity then takes place.

The casting compound 15 is applied onto the respective main body 19. In this situation, ring-shaped shoulders 18 are formed by the casting compound 15 on both sides of the profiles, in order, with the negative process, for the casting compound to be filled essentially in between the negative mold, not represented, and the main body 19.

The main body 19 is formed as ring-shaped, and comprises an outer material, which is encased by the casting compound 15. Very advantageously, the outer casing 20 of this main body 19 is configured as cylindrical, and can therefore be easily produced. It could also be partially conical, however, for example parallel to the surface 24, and contain one or more ring-shaped cut-out openings, into which the casting compound would penetrate and therefore better adherence would be achieved.

The casting compound 15 consists in this situation of a synthetic resin mixture with several suitable constituents, based for example on epoxy resin or polyurethane resin. It is also possible for suitable adhesives to be used. These materials in general exhibit an essentially lower density and better damping properties than metal. It is therefore possible, in comparison with the known positive process and a metallic configuration of the different profiles, for a weight saving of the dressing tool 10 of more than 20% in total to be achieved.

Furthermore, it is produced in such a way that is does not melt during the dressing process, and remains resistant even if high temperatures occur due to the grinding friction between the outer nickel layer 22 containing diamonds and the grinding worm 1.

Figure 3A:
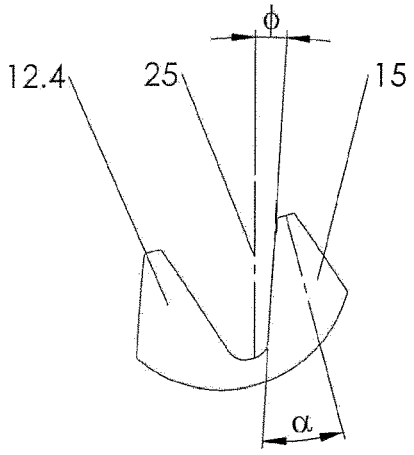
FIG. 3*a* is a detail A1 according to FIG. 3 as a sectional view of profiles.

With regard to the tool part with the conical surface 24, the inclination angle δ of the working surface 14 to the profiles 12.1, 12.2, 12.3, 12.4, formed in each case in cross-section, is selected in such a way that the respective flank of each of these profile teeth, as can be seen in FIG. 3*a*, and with a predetermined engagement angle α, always forms a positive free angle φ with an imaginary line 25 perpendicular to the rotation axis B2 of the dressing tool 10. With a negative free angle φ, this flank of the profile 12.3, in accordance with the detail A1, would essentially form a shadow in the negative mold, and therefore, with the negative process, this profile could not be produced. This free angle φ should therefore amount to 2° to 5°.

Because such a dressing tool 10 is also used as a high-precision tool for fine profiling, a hub-shaped testing collar 16 is assigned to both sides of the main body 19, for checking the roundness of the tool 10 when clamped onto a dressing spindle of a grinding machine.

Figure 3B:
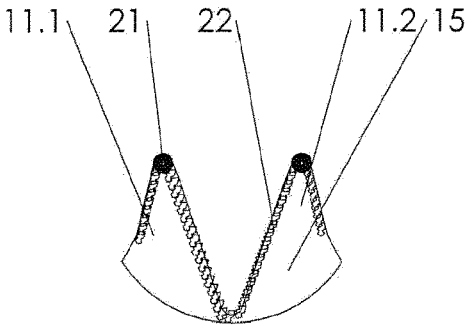
FIG. 3*b* is a detail A2 according to FIG. 3 as a sectional view of profiles.

FIG. 3*b* shows a detail A2 according to FIG. 3, in which this hard material covering is shown schematically on the working surface 13, which is provided with stochastically distributed hard-material particles 22 in the nickel-diamond matrix. Furthermore, hard-material particles 21 are predominantly fixed in the head region of the profiles 11.1 and 11.2 over its circumference. This arrangement can likewise be used with the working surfaces 14 of the profiles 12.1, 12.2, 12.3, 12.4 with the full profile.

According to the invention, with the negative process special hard-material particles 21 are fixed into the base of the complementary profile shape of the negative mold (see FIG. 3*b*). These special hard-material particles are synthetic diamonds from the gas phase. As a result, the region of the head of the dressing tool 10, particularly subject to wear, is protected during the profiling of the screw worm 1.

The hard-material particles 21 applied by the negative process are preferably dimensioned with a grain diameter in the range between 90 and 600 μm and an outer shape preferably as a tetragon, hexagon, octahedron, or dodecahedron. In consequence, the service life of the dressing tool 10 can be appreciably increased overall, because these grain diameters are larger in comparison with known particles. With the previous production of set-profile rollers 6 in the positive process, hard-material particles with grain diameters of this order of size could only be produced with very high manufacturing effort and expenditure due to geometry constraints.

Very advantageously, instead of conventional hard-material particles, a special diamond type is used, which, due to its morphology and formation, incurs a different surface image to the ceramic grinding worm which is to be profiled, and in consequence incurs different properties on the workpiece surface of the gear wheels which are to undergo grinding. In differentiation to conventional diamond grains, due to this special diamond type, the surfaces of the flanks of the grinding worm are provided with defined grinding patterns. A material from a special synthesis type IIA is used for this special diamond type.

With the known negative process, by galvanic application by means of centrifugal force, hard-material particles 21, 22, and an additional nickel layer are conveyed into the profile molds complementary to the negative mold. Next, the main body 19 is set centrically and in a precise axial position into the negative mold, and the viscous casting compound 15 between them is emptied out, such that the complementary profile mold is filled with the casting compound 15. As soon as this has hardened and is connected to the main body 19, the negative mold is removed, with the removal of metal, and there remain only the main body 19 and the hardened casting compound 15, with the adherent hard-material particles 21, 22 in the diamond-permeated nickel matrix, and the dressing tool 10 is thereby produced.

Due to the production of the dressing tool 10 by means of this negative process, oscillations during the dressing procedure can be perceptibly reduced or even brought to a minimum, such that subsequent roll grinding is largely possible with the avoidance of are referred to as ghost frequencies. This is primarily achieved by the combination of this main body 19 and the light casting compound 15 from an oscillation-damping synthetic resin mixture.

Figure 4:
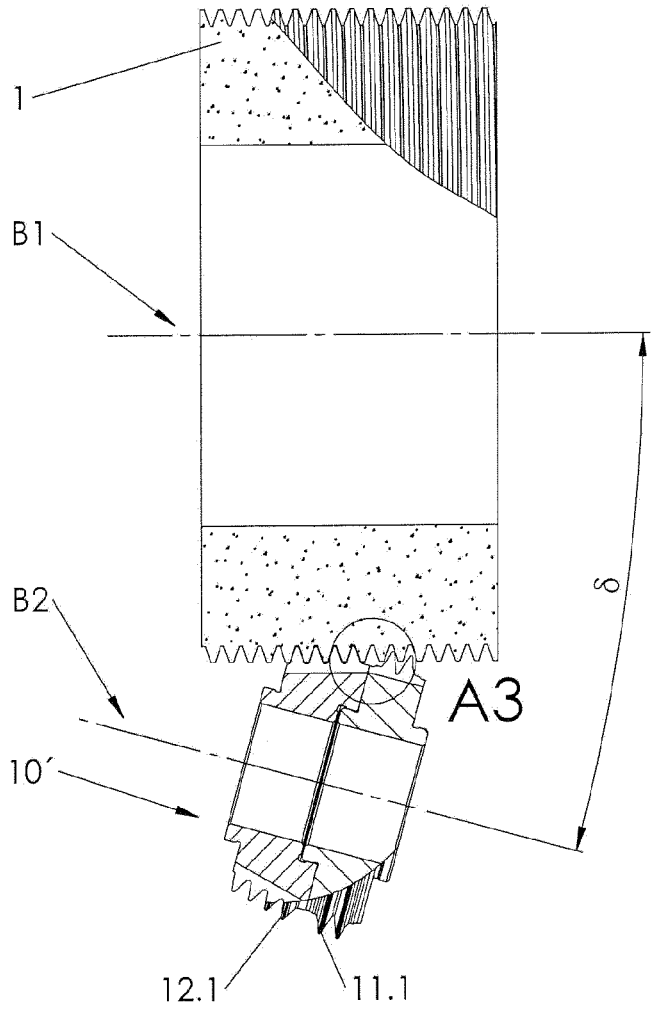
FIG. 4 is a longitudinal section with a partial view of a further dressing tool or a grinding worm respectively, in engagement during the profiling.

FIG. 4 shows a dressing tool 10', which is configured as essentially the same as that according to FIG. 3, and therefore the differences are explained hereinafter. The same reference numbers are used for the same component parts as with the dressing tool 10 according to FIG. 3.

This dressing tool 10' is in engagement in a grinding worm 1, wherein the working surfaces 14 of the profiles 12.1, 12.2, 12.3, 12.4 are in engagement with the full profile, i.e., these profiles in each case undertake profiling with both flanks simultaneously.

According to the invention, in this situation, in FIG. 4, the second embodiment is represented as a two-part dressing tool 10', in distinction to that according to FIG. 3. Both embodiments 10, 10' of this dressing tool, each of which are novel, can be used without distinction between processes for the same profiling of grinding worms 1.

Figure 4A:
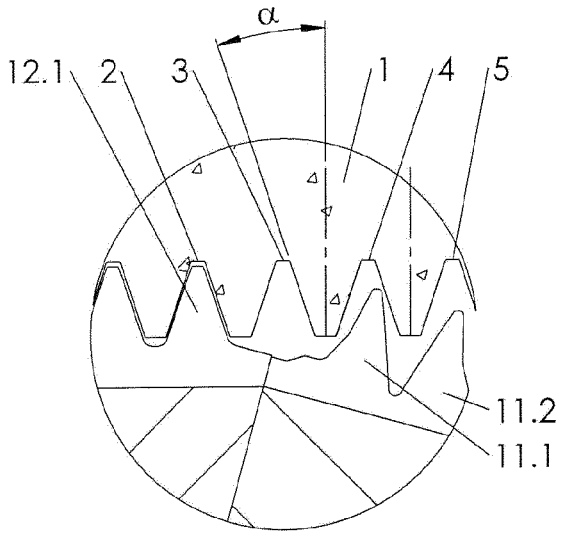
FIG. 4*a* is a detail A3 as a sectional view of the engagement of the one profile of the dressing tool in the grinding worm according to FIG. 4.

In FIG. 4*a*, according to the detail 3A, the tooth gaps 2, 3, 4, 5 of the grinding worm 1 are shown in cross-section, wherein the profile 12.1 (and therefore the entire working surface 14) is in engagement with the grinding worm in the tooth gap 2. The profiles 11.1, 11.2, of the working surface 13, pivoted away, are out of engagement in the tooth gaps 4 and 5. Conversely, the tooth gap 3 is free of profiles.

With the arrangement of this dressing tool 10,10' represented in a graphic display image, it can be seen that if the profile tooth of the profile 11.1 which is not in engagement collides with the profile tooth of the grinding worm which is present in the tooth gap 4, then this profile tooth of the profile 11.1 must be lowered with, as far as possible, an adequate and same distance spacing on both sides to the flanks of the next tooth gap 5 of the grinding worm 1. With very small module sizes, the distance spacing between the two profiles 11.1 and 12.1 can amount to more than two tooth gaps. In this situation, the only delimiting factor is the length of this dressing tool 10, 10', which determines the travel distance required for a dressing stroke. If, by contrast, the display image is in order, then the profile 11.1 is located as far as possible at the same distance spacing to the flanks of the respective tooth gap. The set profile and the full profile can be designed mathematically and/or graphically in accordance with known rules of tooth technology. Accordingly, for the inclination angle $\delta$ of the conical casing surface to the cylindrical surface 23, 24, it is approximately the case that the angle $\delta$ equals the engagement angle $\alpha$ less the free angle $\varphi$.

Figure 4B:
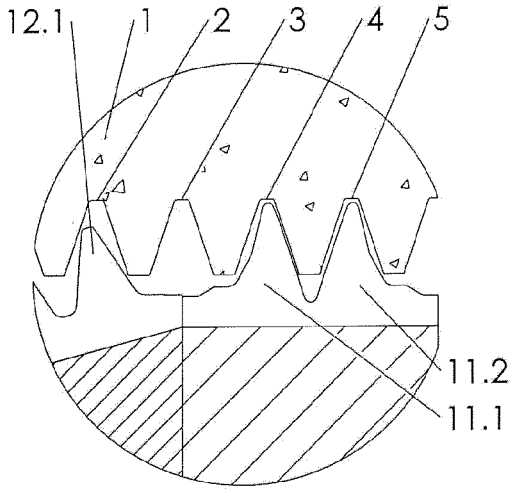
FIG. 4*b* is a detail as a sectional view of the engagement of the other profile of the dressing tool in the grinding worm according to FIG. 4.

Represented in FIG. 4*b*, as an analogous detail, is the situation when the profiles 11.1, 11.2 of the working surface 13 of the set profile is in engagement with the grinding worm 1. With this profiling dressing tool 10', the profiles 11.1, 11.2 are in engagement with the mutually facing flanks, and profile the grinding worm 1 between the tooth gaps 4 and 5. If, in a display image, a collision were to occur between the profile 12.1 and the flanks of the tooth gap 2, then the inclination angle $\delta$ previously determined roughly must be changed in the order of $+/-1°$, or the distance interval between the profiles 11.1 and 12.1 is increased in accordance with the foregoing description.

During the profiling of the grinding worm 1 with the dressing tool 10', first the tool part, rotating at the dressing revolution speed, comes into operation with the profiles 12.1, 12.2, 12.3, 12.4, configured as full profiles, wherein the casing line present in the axial sectional view is pivoted inwards with its conical virtual casing surface 24 parallel to the cylindrical grinding worm 1. When the preliminary profiling of the grinding worm 1 is ended after several dressing strokes, there then follows the thread-by-thread fine profiling of the grinding worm 1 with the tool part configured as a set profile.

For this purpose, the cylindrical surface 23 with the two profiles 11.1 and 11.2 must likewise be pivoted inwards parallel to the cylindrical grinding worm 1 by means of an NC axle. Particularly advantageous in this situation is the fact that the profile angles, which are constantly changing due to the profiling, can be corrected as required in relation to the grinding worm, which becomes smaller in diameter with each dressing procedure, by means of an easily performed pivoting movement of the dressing tool 10. With the use of this novel dressing tool 10, 10', it is therefore relatively easy to carry out highly productive and also highly precise profiling during roll grinding, as well as with the possibility of correction.

While the engagement of the profiles 12.1, 12.2, 12.3, 12.4 as a roughing tool serves for a rapid profiling of the grinding worm which is to undergo grinding, it is also possible, with the profiles 11.1, 11.2, for the intended profile required of the individual worm threads to be produced very precisely and in a correctable manner.

Figure 5:
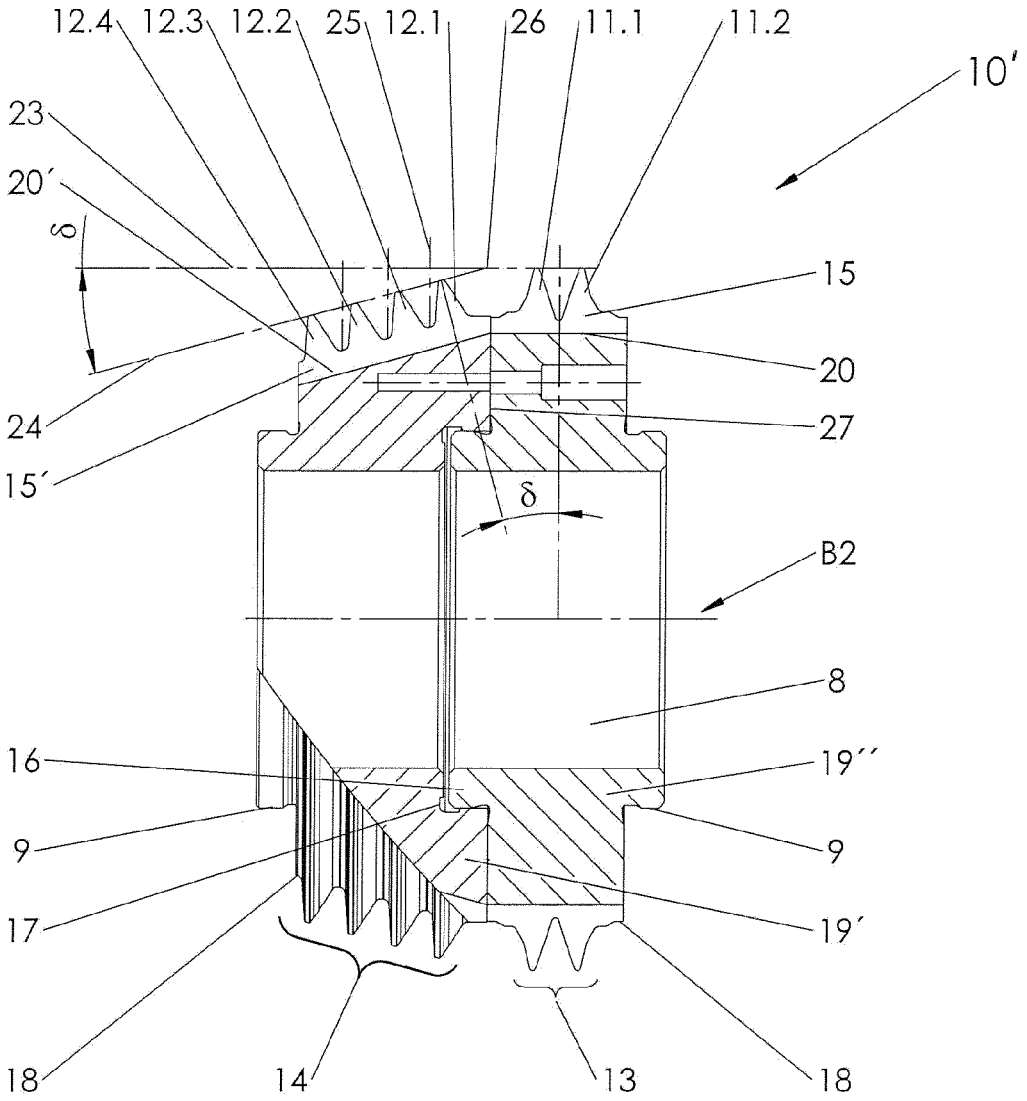
FIG. 5 is a longitudinal section with a partial view of the dressing tool according to FIG. 4.

FIG. 5 shows the dressing tool 10' from FIG. 4, which, as mentioned, is configured as being of two parts, and wherein the profile molds of the profiles 11.1, 11.2, 12.1, 12.2, 12.3, 12.4 are produced in an analogous manner by means of negative processes. The following introduction of a casting compound likewise takes place in an analogous manner.

Within the framework of the invention, with this two-piece dressing tool 10', it is advantageously possible not only for the main body 19, 19' to be configured in general as being of two parts, but also the casting compounds 15, 15' and the hard-material particles 21, 22 with the diamond impregnated nickel matrices. In this situation the negative mold can consist of one piece as well as of two pieces.

In this situation, the main bodies 19', 19" are secured coaxially to one another, and they are advantageously formed in each case on the outer casing 20 parallel to the casing surfaces 23, 24 formed by the profiles. Preferably, the main bodies 19, 19' centred with a high degree of precision by means of a centring hole with an undercut 17, and engaging in this, with a close fit, a centring collar 16, which in each case are ring shaped, for the coaxial alignment with one another. As a result, these main bodies 19, 19' can be matched to one another at a defined distance spacing, and, for example, can be screwed in place. The rotational base surface 27 is, for this embodiment, the base surface for the geometry structure of all the profiles 11.1, 11.2, 12.1, 12.2, 12.3, 12.4, wherein the point of intersection 26 between the two casing surfaces 23, 24 should lie in the immediate vicinity of this base surface 27.

A particularly advantageous embodiment of this dressing tool 10' can consist of the two-piece casting compounds 15, 15' and the hard-material particles 21, 22, with the diamond-permeated nickel matrices, also being configured with different casting compounds and different hard-material particles. For this purpose, the first and second pieces of the dressing tool 10' can be produced separately as individual parts and then screwed together. The effort and expenditure of production is thereby increased, but for both working surfaces 13, 14, preferably optimized hard-material particles 21, 22 and casting compounds 15, 15' can be used.

Accordingly, within the framework of the invention, they can be used either as an optimized combination tool or separately from one another as an individual tool. Depending on the service life of the profiles on a main body 19, 19', the one or the other part can be replaced or exchanged.

The invention has been adequately represented by the exemplary embodiments and examples described heretofore. It can of course also be explained by other variants.

The casing surfaces of the profiles can be configured as conical, cylindrical, and/or in another form, and the profiles of a respective casing surface can be configured as set-profile rollers or as full-profile rollers. Accordingly, the profiles arranged coaxially to one another can form on the outside more than two differently-formed casing surfaces, for example one cylindrical surface and two conical surfaces, each with a different inclination angle $\delta$, from which the profiles of the cylindrical casing surface can be configured as set-profile rollers, and the others as full-profile rollers.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

REFERENCE NUMBER LIST

1 Grinding worm
2 First tooth gap (in accordance with Detail 3A)
3 Second tooth gap (=free gap)
4 Third tooth gap
5 Fourth tooth gap
6 Set-profile roller
7 Full-profile roller
8 Borehole
9 Test collar
10 Dressing tool with one-piece main body
10' Dressing tool with two-piece main body
11.1 First profile of a set-profile
11.2 Second profile of a set-profile
12.1 First profile of a full-profile
12.2 Second profile of a full-profile
12.3 Third profile of a full-profile
12.4 Fourth profile of a full-profile
13 Working surfaces of a set-profile
14 Working surfaces of a full-profile
15 Casting compound
15' Casting compound
16 Centring collar
17 Centring hole with undercut
18 Ring-shaped shoulder
19 Main body
19' Main body
19" Main body
20 Casing surface, cylindrical
20' Casing surface, conical
21 Hard-material particles
22 Hard-material particles in nickel-diamond matrix
23 Casing surface, cylindrical
24 Casing surface, conical
25 Perpendicular line onto B2
26 Intersection point between the surfaces 23 and 24
27 Base surface for the geometrical structure of both working surfaces
B1 Rotation axis of the grinding worm
B2 Rotation axis of the dressing tool
m Module
α Engagement angle
δ Inclination angle
φ Free angle

The invention claimed is:

1. A dressing tool, comprising:

a metallic main body having a ring shape and at least one outer casing, and a casting compound that encases the at least one outer casing of the main body and defines a first set of two profiles and a second set of at least one profile, the at least one outer casing being cylindrical or partially conical, the profiles in the first and second sets of profiles being arranged coaxially to one another and having working surfaces provided with hard material particles, the casting compound comprising a synthetic resin mixture, and the profiles in the first and second sets of profiles forming at least two different shaped casing surfaces at their outer circumference, wherein the two profiles in the first set of two profiles form a first one of the at least two different shaped casing surfaces and the at least one profile in the second set of at least one profile forms a second one of the at least two different shaped casing surfaces, wherein the first one of the at least two different shaped casing surfaces is cylindrical, and the second one of the at least two different shaped casing surfaces is conical, wherein the two profiles in the first set of two profiles are configured as set-profile rollers and each of the at least one profile in the second set of at least one profile is configured as a full-profile roller, the main body comprising a first part that supports the first set of two profiles and a second part that supports the second set of at least one profile, the first and second parts being alternatively separable from one another and secured coaxially to one another to provide the dressing tool as a two-part dressing tool, the at least one outer casing comprising a first outer casing on the first part of the main body and a second outer casing on the second part of the main body, the first and second parts of the main body being centered by means of a centering hole on one of the first and second parts and a centering collar on the other of the first and second parts that engages with the centering hole to provide for coaxial alignment of the first and second parts of the main body, the first and second parts of the main body being releasably screwed together to enable the first and second parts of the main body to be alternatively separable from one another and secured to one another.

2. The dressing tool according to claim 1, wherein the first set of two profiles consist of only these two profiles.

3. The dressing tool according to claim 1, wherein the first set of two profiles comprises these two profiles which each have a conical shape in axial cross-section.

4. The dressing tool according to claim 1, wherein the at least one profile in the second set of at least one profile comprising four profiles.

5. The dressing tool according to claim 1, wherein the profiles in the first and second sets of profiles each have a conical shape in axial cross-section.

6. The dressing tool according to claim 1, wherein the first outer casing is parallel to the first one of the different shaped casing surfaces and the second outer casing is parallel to the second one of the different shaped casing surfaces.

7. The dressing tool according to claim 1, wherein an inclination angle (δ) is present between two adjacent ones of the at least two different shaped casing surfaces, the at least one profile in the second set of profiles comprising first and second adjacent profiles each comprising a profile tooth, and the profile tooth of the first profile in the second set of profiles having a predetermined engagement (α), with an imaginary perpendicular line to a rotation axis always exhibiting a positive free angle (φ) to a next located flank of the profile tooth of the second profile in the second set of profiles.

8. The dressing tool according to claim 1, wherein adjacent working surfaces of the profiles in the first and second sets of profiles are spaced at a distance interval to a base surface such that, at a grinding worm to be profiled, with four defined tooth gaps, one of the tooth gaps is always free, and either the first set of two profiles or the second set of at least one profile is pivotable into any residual tooth gaps without any collision.

9. The dressing tool according to claim 1, wherein the synthetic resin mixture of the casting compound comprises epoxy resin.

10. The dressing tool according to claim 1, wherein the synthetic resin mixture of the casting compound comprises polyurethane resin.

11. The dressing tool according to claim 1, wherein the profiles of the first and second sets of profiles are produced by a negative process with the casting compound applied on the main body.

12. The dressing tool of claim 1, wherein the centering hole includes an undercut.

* * * * *